US009422027B2

(12) United States Patent
Murray et al.

(10) Patent No.: US 9,422,027 B2
(45) Date of Patent: Aug. 23, 2016

(54) SPAR HULL CENTERWELL ARRANGEMENT

(75) Inventors: John James Murray, Houston, TX (US); Guibog Choi, Houston, TX (US)

(73) Assignee: FloaTEC, LLC, Houston, TX (US)

( * ) Notice: Subject to any disclaimer, the term of this patent is extended or adjusted under 35 U.S.C. 154(b) by 1099 days.

(21) Appl. No.: 12/979,440

(22) Filed: Dec. 28, 2010

(65) Prior Publication Data

US 2011/0265701 A1 Nov. 3, 2011

Related U.S. Application Data

(60) Provisional application No. 61/328,889, filed on Apr. 28, 2010.

(51) Int. Cl.

| | |
|---|---|
| ***B63B 35/44*** | (2006.01) |
| ***E21B 17/01*** | (2006.01) |
| ***B63B 1/04*** | (2006.01) |

(52) U.S. Cl.

CPC ..... *B63B 1/048* (2013.01); *B63B 35/44* (2013.01); *B63B 35/4406* (2013.01); *E21B 17/01* (2013.01); *B63B 2035/442* (2013.01)

(58) Field of Classification Search

CPC ..... E21B 17/00; E21B 17/01; E21B 17/012; B63B 35/44; B63B 35/4413; B63B 22/00; B63B 22/02

USPC ..... 114/256, 264; 405/205, 210, 223.1, 405/224.2

See application file for complete search history.

(56) References Cited

U.S. PATENT DOCUMENTS

| | | | | |
|---|---|---|---|---|
| 4,606,673 | A * | 8/1986 | Daniell | 405/210 |
| 4,702,321 | A * | 10/1987 | Horton | 114/256 |
| 6,488,447 | B1 * | 12/2002 | Nish et al. | 405/224.2 |
| 2004/0052586 | A1 | 3/2004 | Horton | |
| 2008/0056829 | A1 | 3/2008 | Horton et al. | |
| 2009/0158987 | A1 | 6/2009 | Ramachandran et al. | |

OTHER PUBLICATIONS

Summary of Mexican Office Action for Application No. MX/a/2011/004332.

* cited by examiner

*Primary Examiner* — Lars A Olson
(74) *Attorney, Agent, or Firm* — Patterson & Sheridan, LLP

(57) ABSTRACT

A spar hull centerwell arrangement wherein an adjustable buoyancy centerwell device (ABCD) is disposed within the centerwell of the structure. The adjustable buoyancy centerwell device is rigidly connected to the interior walls of the hard tank and defines an adjustable buoyancy centerwell device within the centerwell. The adjustable variable buoyancy unit is a water and airtight buoyancy chamber that allows the interior ballast to be changed as required. This device can also be used as a storage unit for on board fluids and other produced hydrocarbons.

7 Claims, 8 Drawing Sheets

SPAR HULL CENTERWELL ARRANGEMENT

PRIORITY CLAIM

This application claims priority from Provisional Application Ser. No. 61/328,889 filed Apr. 28, 2010.

FIELD AND BACKGROUND OF INVENTION

The invention is generally related to floating offshore structures and more particularly to the centerwell arrangement of a spar type hull.

There are a number of spar hull designs available in the offshore oil and gas drilling and production industry. These include the truss spar, classic spar, and cell spar. The term spar hull structure described herein refers to any floating structure platform, which those of ordinary skill in the offshore industry will understand as any floating production and/or drilling platform or vessel having an open centerwell configuration.

A spar hull is designed to support a topsides platform and riser system used to extract hydrocarbons from reservoirs beneath the seafloor. The topsides support equipment to process the hydrocarbons for export to transport pipelines or to a tanker for transport. The topsides can also support drilling equipment to drill and complete the wells penetrating the reservoir. The product from these wells is brought up to the production platform on the topsides by risers. The riser systems may be either flexible or steel catenary risers (SCRs) or top tensioned risers (TTRs) or a combination of both.

The catenary risers may be attached at any point on the spar hull and routed to the production equipment on the topsides. The routing may be on the exterior of the hull or through the interior of the hull. The TTRs are generally routed from wellheads on the seafloor to the production equipment on the topsides platform through the open centerwell.

These TTRs may be used for either production risers to bring product up from the reservoir or as drilling risers to drill the wells and provide access to the reservoirs. In some designs where TTRs are used, either buoyancy cans or pneumatic-hydraulic tensioners can support (hold up) these risers. When buoyancy cans are used, the buoyancy to hold up the risers is supplied independently of the hull and when tensioners are used these tensioners are mounted on the spar hull and thus the buoyancy to hold up the risers is supplied by the spar hull. In either method of supporting the risers, TTRs are generally arranged in a matrix configuration inside an open centerwell. The spacing among the risers in this centerwell location is set to create a distance among the risers that allows manual access to the production trees mounted on top of the risers.

The spar type structure which supports the topsides comprises a hard tank and other structural sections such as a truss and a soft tank or the hull can be completely enclosed as a cylinder. The hard tank supplies the majority of the buoyancy to support the hull structure, risers, and topsides platform. The hard tank is compartmentalized into a plurality of chambers among which the ballast can be shifted to control the hull's stability.

The centerwell configuration forms an open volume in the center of the hard tank referred to as the open centerwell. Since the centerwell is open to the sea it does not contribute to the hull structure's buoyancy. This offers a potential to displace the sea water in the centerwell and capture the buoyancy. The primary advantage of capturing this buoyancy is that the diameter of the hard tank can be reduced. This offers specific benefits in construction, transportation and installation of the spar hull.

SUMMARY OF INVENTION

The present invention addresses the shortcomings in the known art and is drawn to a spar hull open centerwell arrangement wherein an adjustable buoyancy centerwell device (ABCD) unit is disposed within the open centerwell of the structure. The ABCD is rigidly connected to the interior walls of the hard tank and defines an adjustable buoyancy compartment device within the centerwell. The ABCD is a water and airtight buoyancy chamber that allows the interior ballast to be changed as required.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
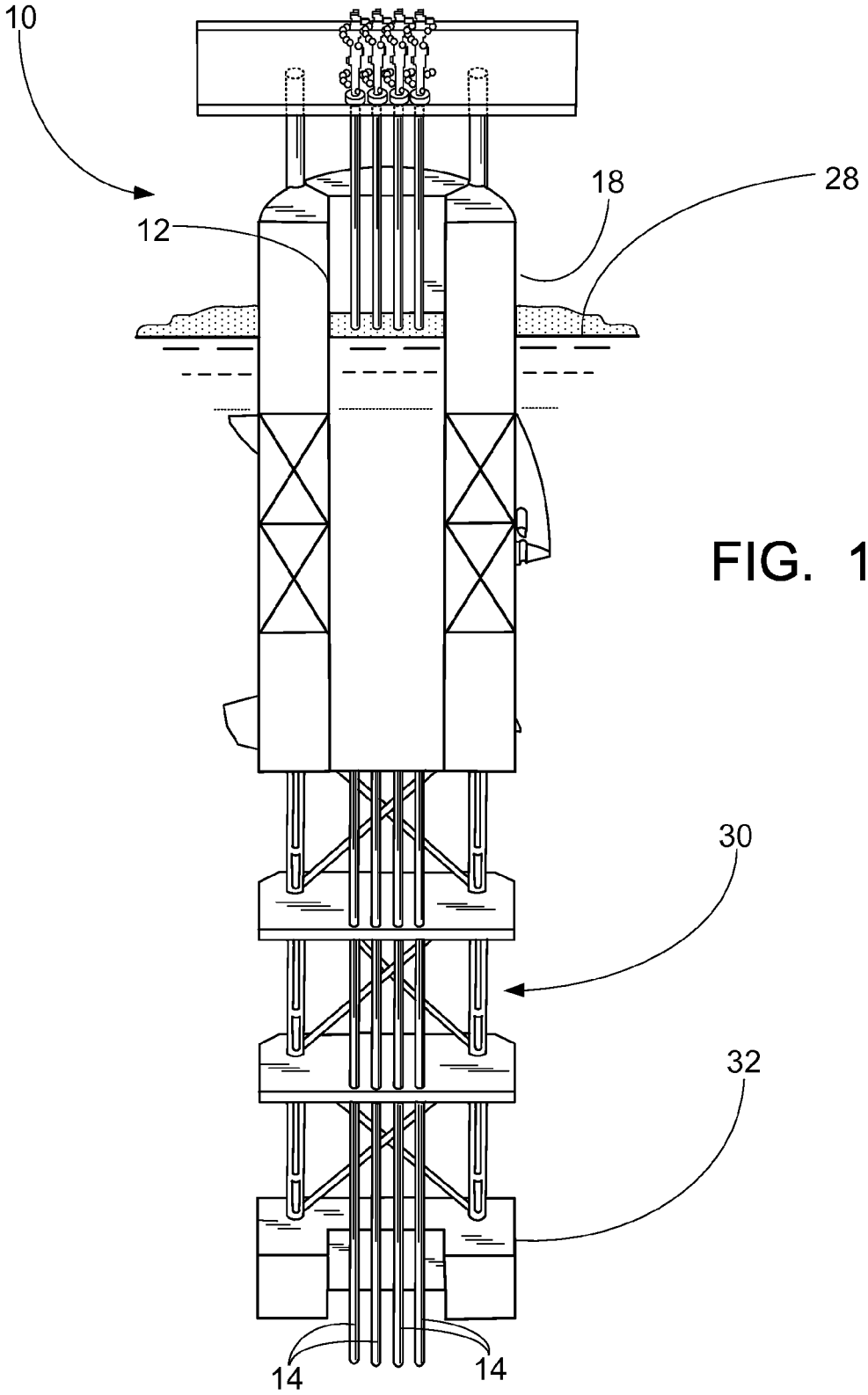
FIG. 1 is a sectional view of a typical truss spar with an open centerwell.

FIG. 1 is a sectional view of a truss spar 10 with a traditional open centerwell 12. It is seen that the risers 14 are received in the open centerwell 12. As described in the background above, the traditional open centerwell 12 is open to the sea water 28. The truss section 30 extends downward from the hard tank 18. A soft tank 32 at the lower end of the truss section 30 is used to adjust buoyancy as needed.

Figure 2:
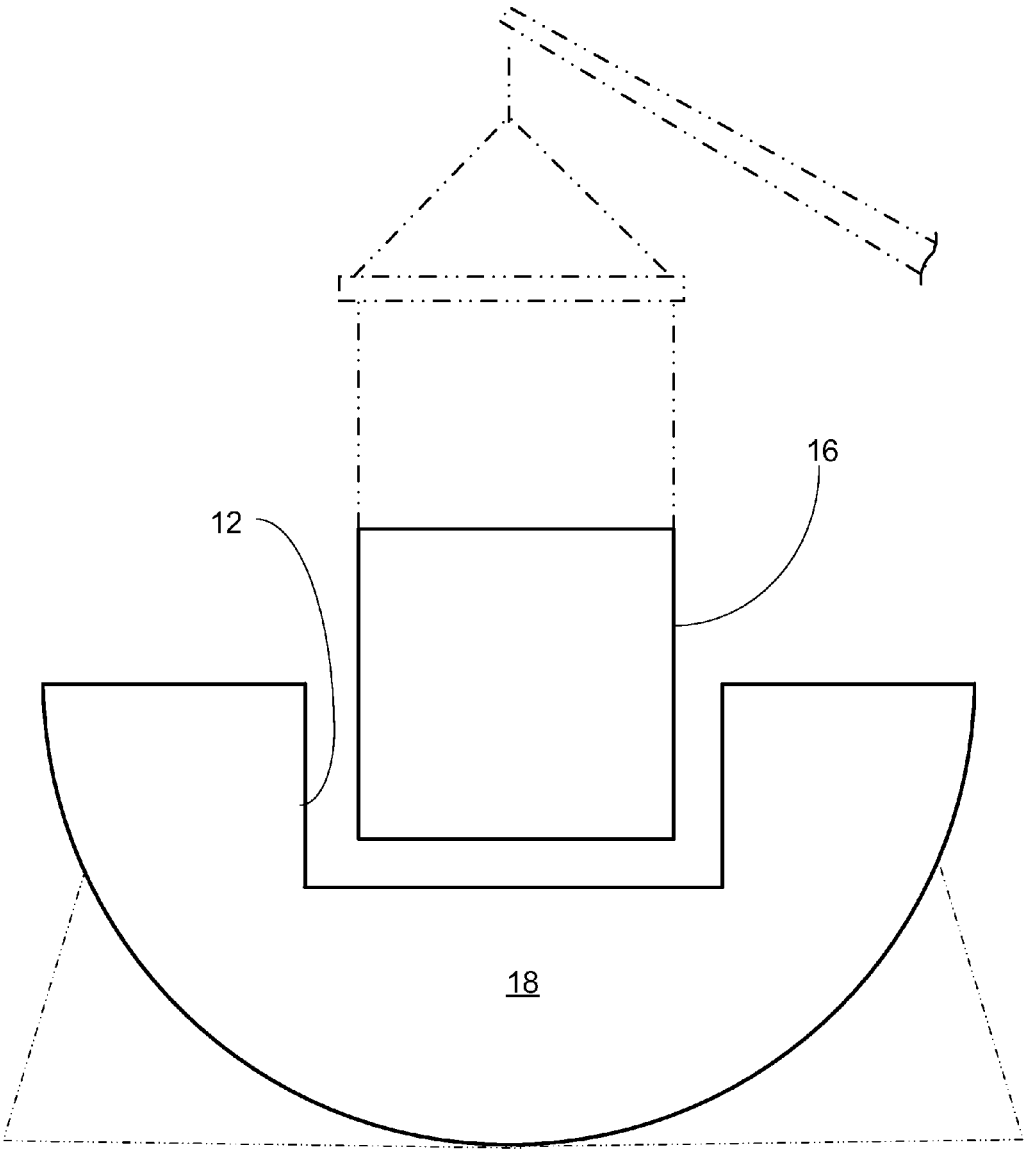
FIG. 2 schematically illustrates the installation of the invention during construction of the spar.
Figure 3:
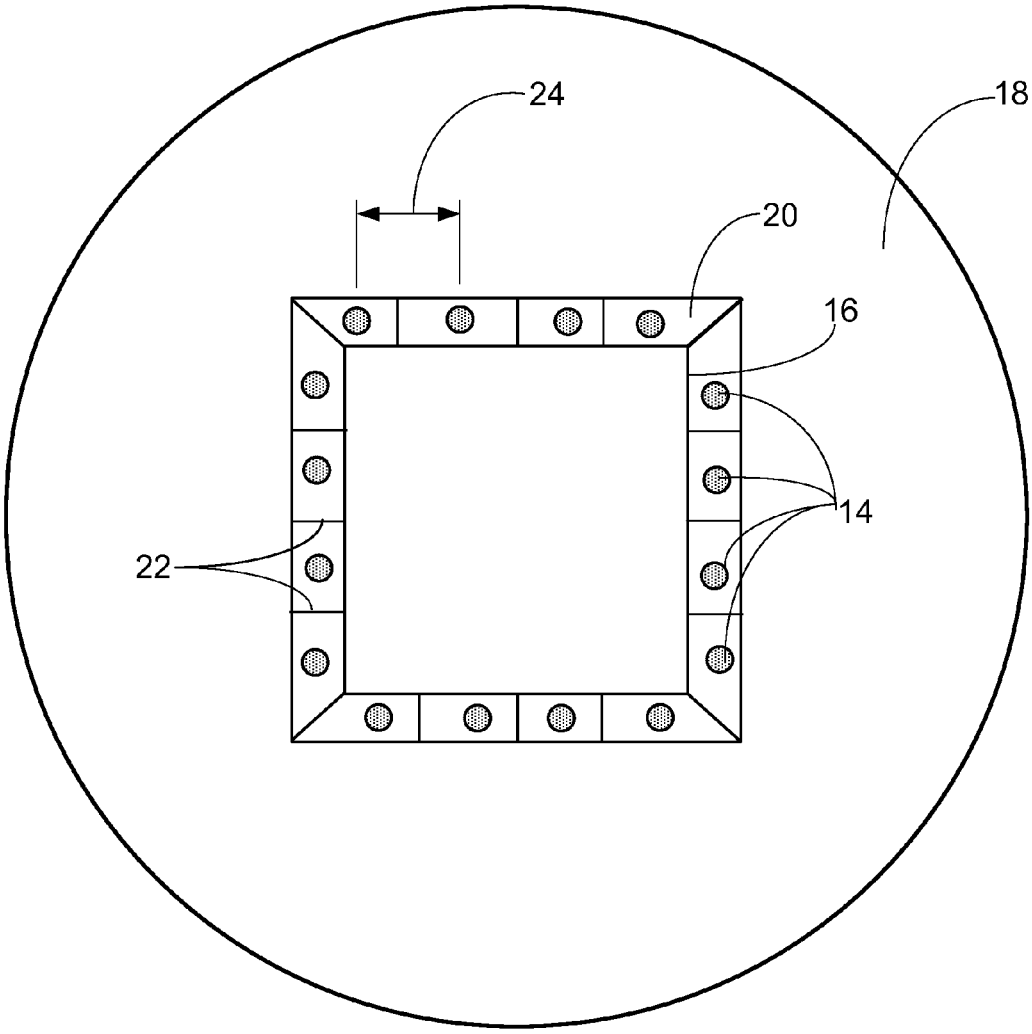
FIG. 3 is a sectional view of a spar hard tank with the invention installed.

FIG. 2 illustrates the invention 16, generally referred to as the adjustable buoyancy centerwell device (ABCD), being lifted into place during construction of the spar 10. Due to the size (typically 80-150 feet in diameter and as much as 200-300 feet long), the spar hard tank 18 is typically built in sections with the spar 10 in the horizontal position. Thus, the ABCD 16 is more easily installed when the spar is on its side and the centerwell 12 is easily accessible. There are various construction methods to install the ABCD, depending on the construction facility and capabilities. As seen in FIGS. 2 and 3, the ABCD 16 is sized to have outer dimensions that are less than the inner dimensions of the centerwell in the completed spar. When installed and held in position, this defines a space 20 between the outer surface of the ABCD 16 and the inner surface of the centerwell 12. The ABCD 16 is a rigid structure made of suitable material for the offshore environment, such as steel, and is closed at the bottom to prevent entry of sea water and provide additional buoyancy to the spar structure. The ABCD 16 may be provided with a plurality of separate water tight and air tight chambers 26 for selectively adjusting the buoyancy as required during drilling and production operations offshore.

FIG. 3 illustrates the ABCD 16 installed in the hard tank 18 of a spar structure. A plurality of shear plates 22 are rigidly attached between the ABCD 16 and hard tank 18 to hold the ABCD 16 in place and define the space 20 between the ABCD 16 and the hard tank 18. The space 20 provides room for risers 14. The spacing between the risers 14 is indicated by numeral 24.

Figure 4:
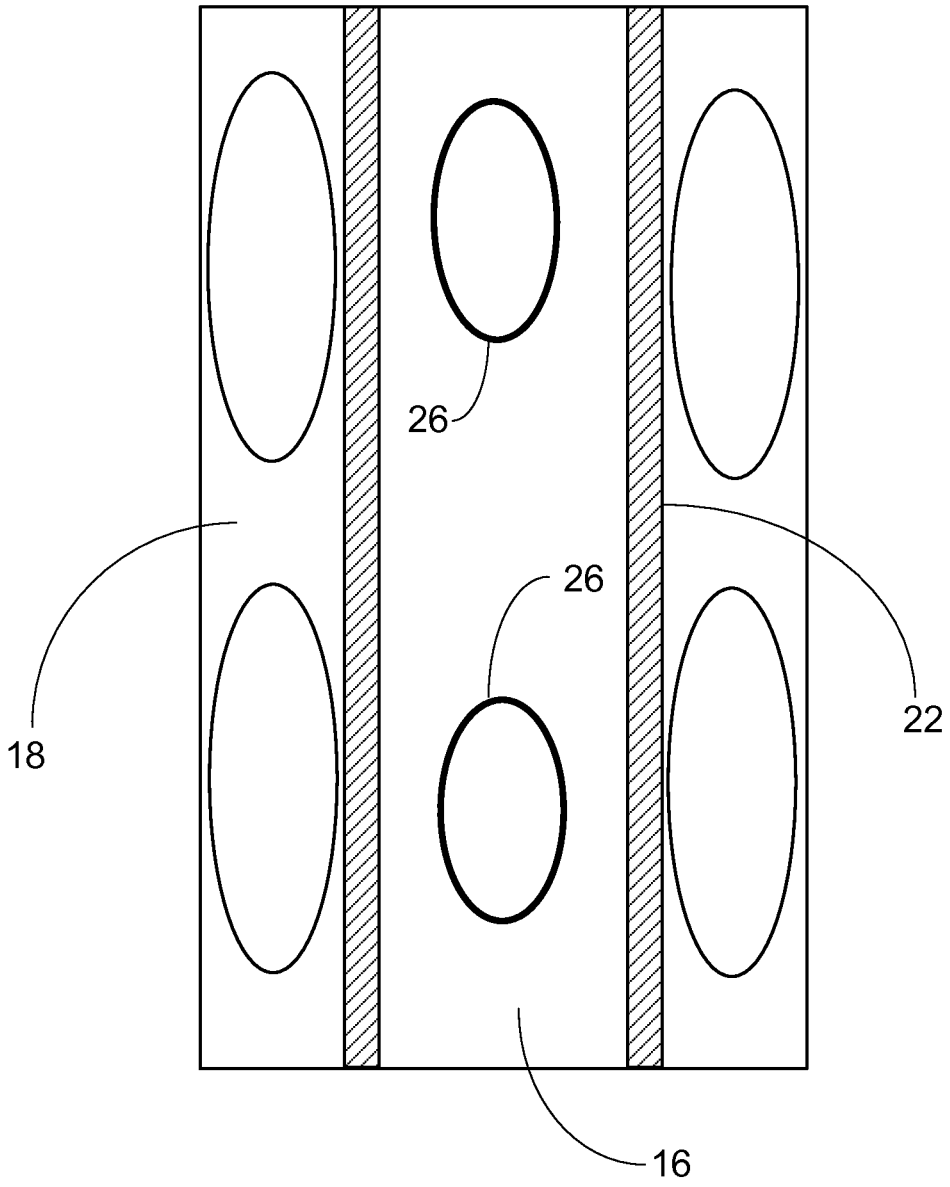
FIG. 4 is a side sectional view of a spar hard tank with the invention installed.

FIG. 4 is a partial side sectional view that illustrates the ABCD 16 installed in the spar. For ease of illustration, the risers are not shown in this drawing figure.

Figure 5:
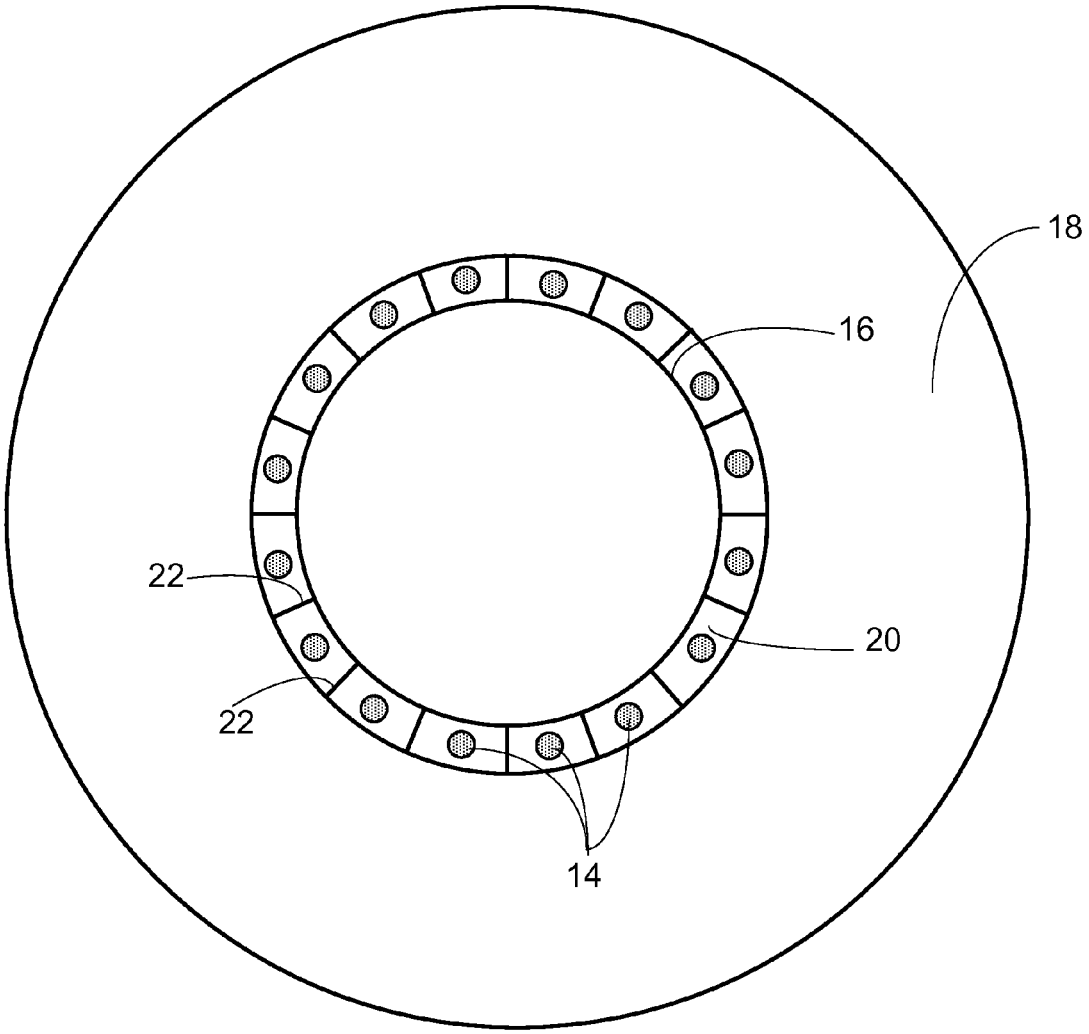
FIG. 5 is a sectional view that illustrates an alternate shape of the invention installed in a spar.

FIG. 5 illustrates an alternate embodiment wherein the centerwell 12 of the spar and the ABCD 16 are both circular in cross section.

Figure 6:
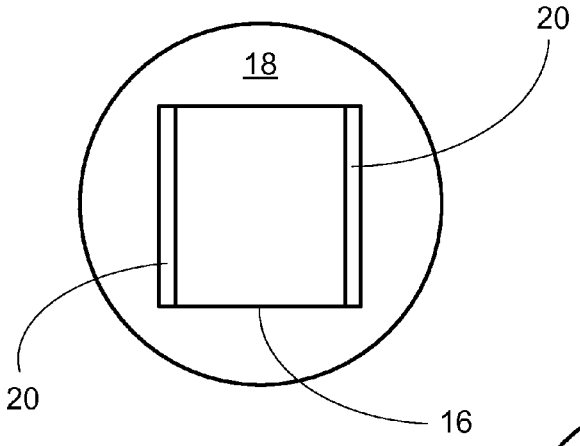
FIGS. 6-8 illustrate alternate arrangements of the invention.

FIG. 6 shows an alternate embodiment in which the space 20 for risers is provided on only two sides of the ABCD 16. In this embodiment, the ABCD 16 is rectangular in shape with two opposing sides that have outer dimensions less than the inner dimensions of the centerwell 12 and the remaining two opposing sides of the ABCD 16 have outer dimensions that closely match the inner dimensions of the centerwell 12.

Figure 7:
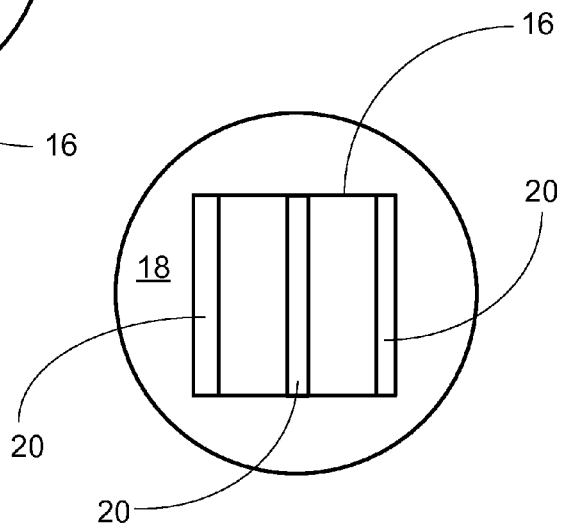

FIG. 7 shows an alternate embodiment in which three spaces 20 are provided for risers. This is similar to the embodiment of FIG. 6, with an extra space in the center. This will require either the use of two separate ABCD units 16 attached to the centerwell 12 or a single ABCD unit 16 that includes a center cut out to provide a space for the risers.

Figure 8:
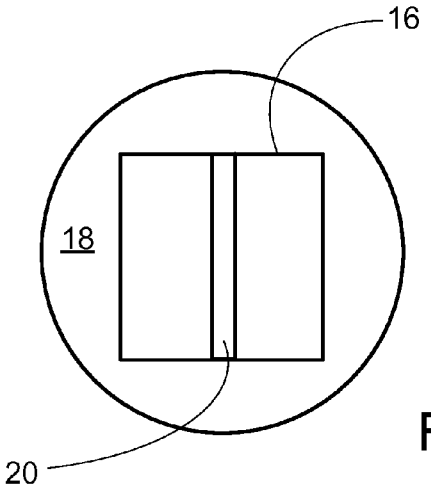

FIG. 8 shows an alternate embodiment in which the space 20 for the risers is provided across the center instead of the perimeter. Again, this will require either the use of two separate ABCD units 16 attached within the centerwell 12 or a single ABCD unit 16 that includes a center cut out to provide a space for the risers. As a single unit ABCD 16, it will have outer dimensions that closely match the inner dimensions of the centerwell 12 and a cut out across the center to provide a space for the risers.

The configuration of FIG. 3 may also be used to store fluids and other materials inside the ABCD 16. This provides for fluid storage inside the spar hard tank 18 and protects the fluid storage container (ABCD 16) from collision while maintaining the traditional spar architecture.

The configuration of FIG. 6 may also be used for fluid storage inside the ABCD 16. In this configuration the ABCD storage unit 16 is connected to internal centerwell bulkheads while the hard tank 10 provides buoyancy compartments in the normal manner.

The invention provides several advantages over the known art, including increased buoyancy, reduced size and weight (reduced hull diameter), and simple and effective means to adjust the buoyancy of the platform as conditions change. The effect of these advantages is explained below.

Construction and delivery of the spar includes a number of phases where the spar hull is in the horizontal position. The hull can be transported on a heavy lift vessel and brought to a near shore shallow water location where it is floated off the transport vessel. Alternatively, the hull can be built near its deployment site and transferred to the water without transportation. In either case it is typical that the hull is temporarily moored to a dock or quayside for additional work while in the horizontal position before being towed to the installation site in deep open water further offshore. The water depth in the vicinity of docks suitable for building such a structure, such as a shipyard, is normally shallow, in the range of 40 to 45 feet. It is critical that the hull not contact the seabed during this operation. The reduced hull diameter provides the advantage of floating capability in such shallow dock areas.

Most spars, whether from U.S. Pat. No. 4,702,321 (known in the industry as the Classic Spar) or from U.S. Pat. No. 5,558,467 (known in the industry as the Truss Spar), are equipped with helical strakes on the exterior of the hull. The purpose of these strakes is to reduce the motions caused by vortex shedding. In general practice the distance the strakes extend off the spar wall is 13% to 15% of the hard tank diameter. Spar hulls constructed to date have a hull diameter from 80 to 150 feet. This means that the strake will extend radially from the hull a distance of approximately 10.4 to 22.5 feet, depending on the diameter of the hull. This strake height is a consideration when towing the hull in shallow water or near a quayside used in the construction of the spar hull. When the spar diameter is large or the water is shallow, the strake can come into contact with the seabed. In cases where the strake will contact the seabed, the solution is to cut the strake to provide the necessary clearance. The consequence of cutting the tip of the strake is diminished effectiveness in reducing the motions caused by vortex shedding. If the standard strake size is to be retained, then the consequence is the need to attach the strake or strakes in deeper water away from the construction yard, which increases the complexity and cost of the work. Reducing the diameter of the hull reduces the height of the strake and provides increased clearance under the keel.

Figure 9:
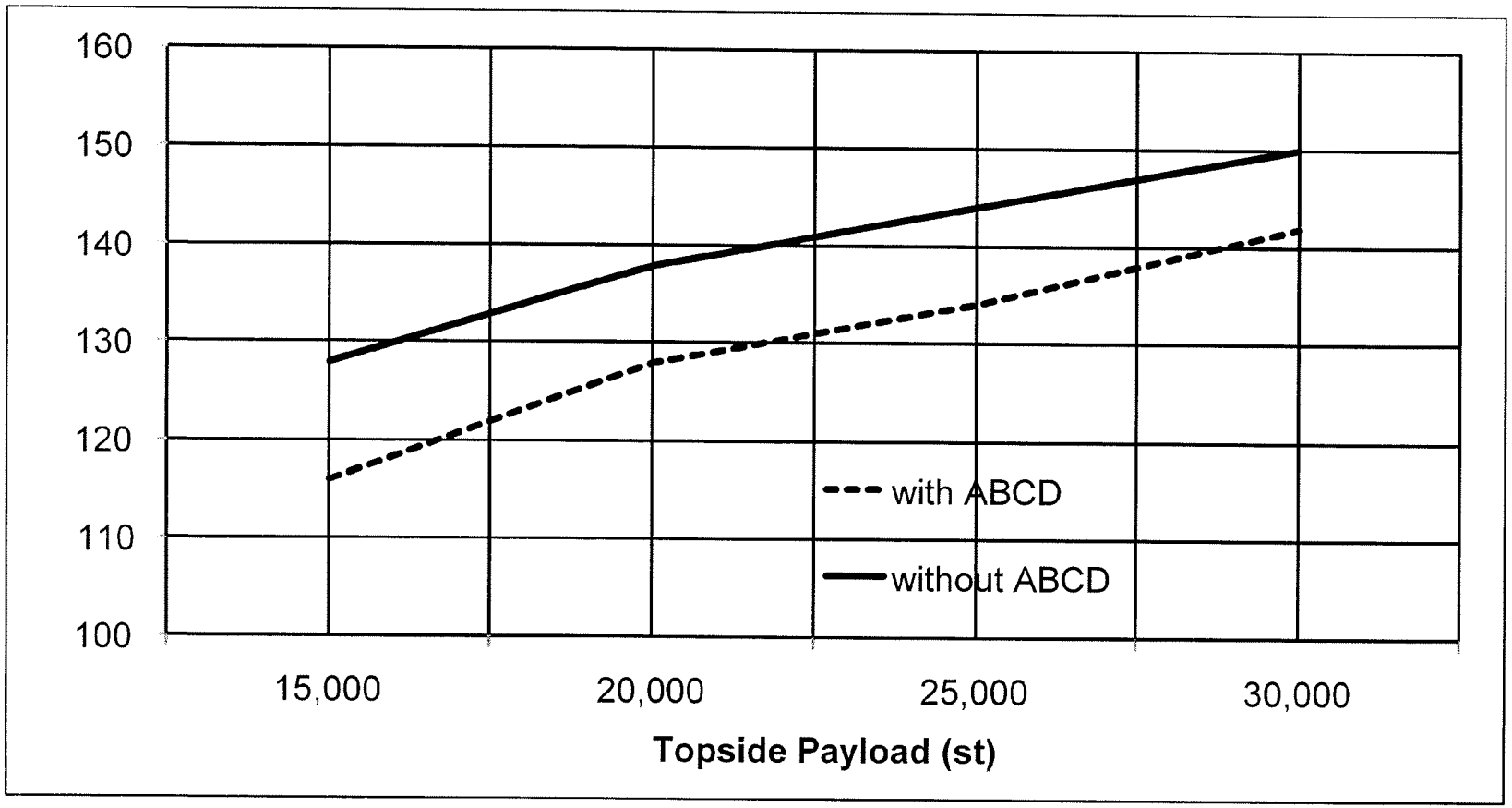
FIG. 9 is a graph that compares spar hull diameter of the prior art and a spar hull with the invention.

The diameter of a spar hull is highly dependent on the payload it is supporting. Some advantage can be taken by lengthening the spar hull. However, to illustrate the effectiveness of the ABCD on reducing the hull diameter, presume the overall length of the Spar is held constant at 555 feet. The diameter of a Truss Spar of this length and having an open centerwell required to support a range of topside weights is shown in the graph of FIG. 9. The same graph shows the diameter of the spar when the ABCD of the invention is used.

Figure 10:
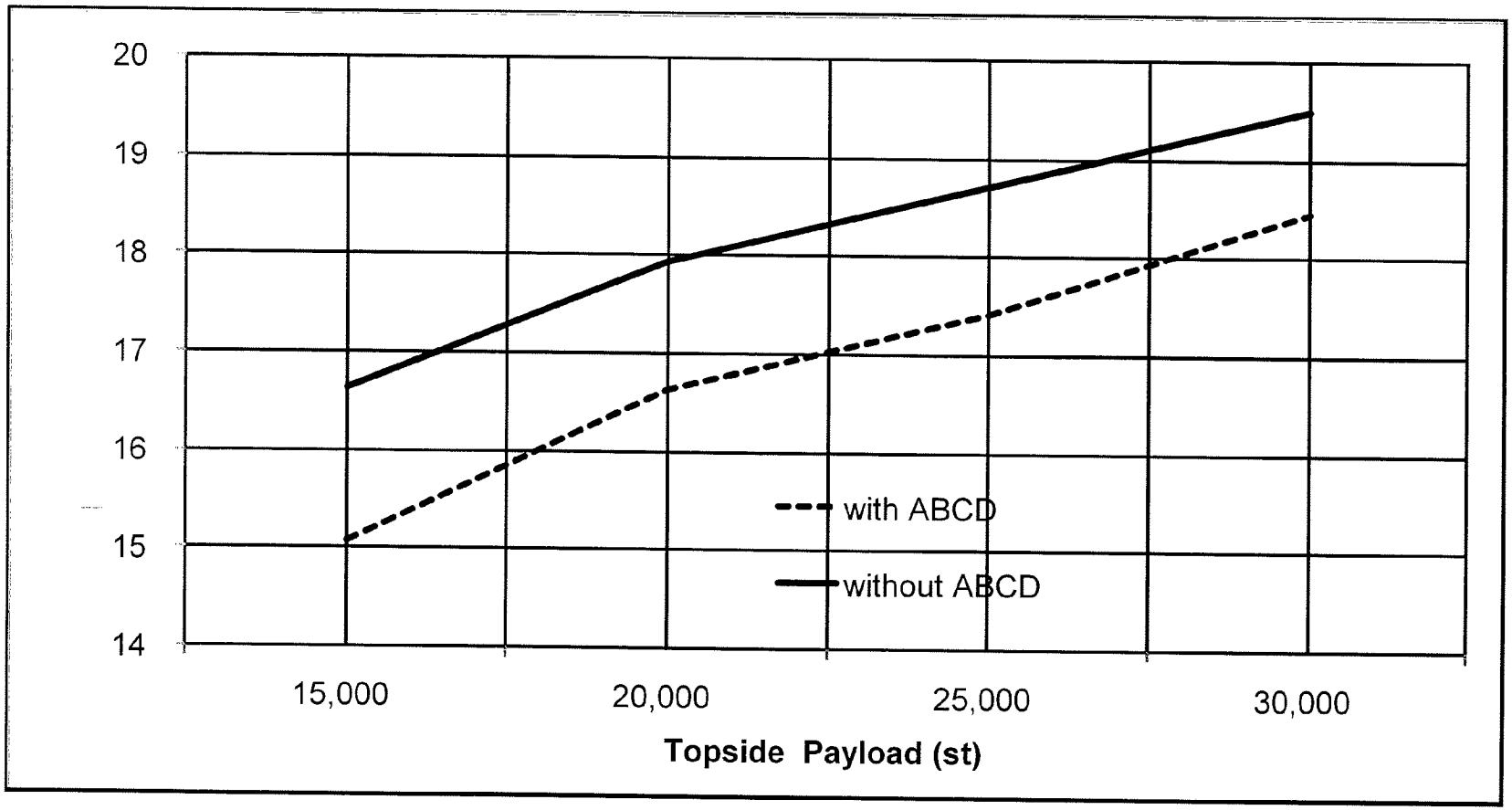
FIG. 10 is a graph that compares strake size on spar hulls with and without the invention.

The graph of FIG. 10 compares the strake heights on the hulls. The graph shows that strake height is reduced by approximately two feet for the Spars with the ABCD of the invention.

A valve tree may be mounted on top of a top tensioned riser (TTR). The purpose of the tree is to provide access to the reservoir wells to carry out interventions that stimulate and control the well as part of normal operations. The access port to the wells is at this tree. When the tree is mounted on a well head on the sea floor, it is known as a wet tree. In the wet tree case, an additional vessel known as a mobile offshore drilling unit (MODU) is connected to the subsea tree to gain access to the well to carry out the intervention. When the tree is mounted on top of the TTR, it is known as a dry tree and interventions can be carried out directly from the vessel supporting the TTRs and therefore the MODU is not required. The economic advantages of the dry tree over the wet tree are well known in the industry.

In the traditional open centerwell, the TTRs are arranged in a matrix formation. A skidding apparatus that traverses the centerwell in two directions is used to move the intervention equipment above the trees and enter the wells. In the traditional open centerwell, the space within the centerwell is occupied by the risers and cannot be otherwise utilized. When the ABCD is installed in the centerwell, the risers are rearranged to occupy the gap on the perimeter of the ABCD as illustrated in FIG. 3. Arranging the risers in this pattern offers a number of advantages to the overall design of the hull. For example, it allows access to the space within the centerwell above the ABCD which can be utilized for other functions such as installation of drilling or production equipment, onboard storage, or as a general lay-down area.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles.

What is claimed as invention is:

1. A spar hull centerwell arrangement, comprising:

a. an adjustable buoyancy device positioned in the centerwell of the spar hull;

b. said buoyancy device being rigidly connected to the centerwell by a plurality of shear plates; and c. said buoyancy device having outer dimensions less than the inner dimensions of the centerwell such that a space is defined between the buoyancy device and the centerwell.

2. The spar hull centerwell arrangement of claim 1, wherein the adjustable buoyancy device is configured for storage of fluids.

3. A spar hull centerwell arrangement, comprising:

a. an adjustable buoyancy device positioned in the centerwell of the spar hull;

b. said buoyancy device being rectangular in shape and rigidly connected to the centerwell; and c. said buoyancy device having outer dimensions on two opposing sides that are less than the inner dimensions of the centerwell such that a space is defined between said two opposing sides of lesser dimensions than the centerwell and outer dimensions on the remaining opposing sides of the buoyancy device that closely match the inner dimensions of the centerwell.

4. The spar hull centerwell arrangement of claim 3, wherein said adjustable buoyancy device further includes an open space that is sized to receive risers.

5. The spar hull centerwell arrangement of claim 3, wherein the adjustable buoyancy device is configured for storage of fluids.

6. A spar hull centerwell arrangement, comprising:

a. an adjustable buoyancy device positioned in the centerwell of the spar hull;

b. said buoyancy device having outer dimensions that closely match the inner dimension of the centerwell and being rigidly connected to the centerwell; and c. said buoyancy device having an open space sized to receive risers.

7. The spar hull centerwell arrangement of claim 6, wherein the adjustable buoyancy device is configured for storage of fluids.

* * * * *